United States Patent [19]

Gibbs et al.

[11] Patent Number: 4,567,902

[45] Date of Patent: Feb. 4, 1986

[54] TOBACCO TRIMMER DEVICE

[75] Inventors: Robert D. Gibbs; James A. Remington, both of Richmond, Va.

[73] Assignee: Philip Morris Incorporated, New York, N.Y.

[21] Appl. No.: 522,149

[22] Filed: Aug. 11, 1983

[51] Int. Cl.[4] ..... A24C 5/18

[52] U.S. Cl. ..... 131/84.4

[58] Field of Search ..... 131/84 R, 84 C

[56] References Cited

U.S. PATENT DOCUMENTS

| | | | |
|---|---|---|---|
| 548,686 | 10/1895 | Williams . | |
| 2,660,177 | 11/1953 | Rault | 131/66 |
| 2,660,178 | 11/1953 | Rault | 131/84 |
| 2,938,521 | 5/1960 | Lanore | 131/84 C |
| 3,030,966 | 4/1962 | Lanore | 131/84 |
| 3,032,041 | 5/1962 | Lanore | 131/61 |
| 3,088,467 | 5/1963 | Lanore | 131/84 C |
| 3,089,497 | 5/1963 | Molins et al. | 131/84 C |
| 3,192,931 | 7/1965 | Lanore | 131/61 |
| 3,242,927 | 3/1966 | Labbe | 131/84 C |
| 3,244,184 | 4/1966 | Petru | 131/84 |
| 3,291,137 | 12/1966 | Labbe | 131/84 |
| 3,338,247 | 8/1967 | Labbe | 131/84 C |
| 3,495,599 | 2/1970 | Molins | 131/84 |
| 3,608,562 | 9/1971 | Gomann | 131/84 C |
| 3,712,160 | 1/1973 | Preston et al. | 83/4 |
| 3,769,989 | 11/1973 | Labbe et al. | 131/84 C |
| 3,880,171 | 4/1975 | Naylor | 131/84 C |
| 4,210,159 | 7/1980 | Quarenghi | 131/84 C |
| 4,276,891 | 7/1981 | Dyett | 131/84 C |
| 4,280,516 | 7/1981 | Reuland | 131/84 C |
| 4,306,573 | 12/1981 | Rudszinat | 131/84 |

FOREIGN PATENT DOCUMENTS

| | | | |
|---|---|---|---|
| 139666 | 12/1903 | Fed. Rep. of Germany | 131/84 C |
| 2103202 | 7/1972 | Fed. Rep. of Germany | 131/84 C |
| 2529456 | 1/1977 | Fed. Rep. of Germany | 131/84 C |
| 0919150 | 2/1963 | United Kingdom | 131/84 C |
| 941853 | 11/1963 | United Kingdom | 131/84 C |
| 2072483 | 10/1981 | United Kingdom | 131/84 C |

*Primary Examiner*—V. Millin

[57] ABSTRACT

A tobacco stream is formed on the underside of a vacuum belt conveyor and is transported past a tobacco trimming device (18) to be converted into a rod-like filler which is draped onto cigarette paper and severed to yield discrete cigarettes which are united with filter plugs. Trimming device 18 consists of overlapping disc knives (19) and (20). Overlapping of disc knives (19) and (20) eliminates the need for brushes to remove excess tobacco.

4 Claims, 5 Drawing Figures

TOBACCO TRIMMER DEVICE

BACKGROUND OF THE INVENTION

This invention relates to a method and apparatus for making a continuous rod of tobacco or other smokeable material. More particularly, the invention relates to improvements in the tobacco trimming device used in a continuous rod cigarette making machine.

DESCRIPTION OF THE PRIOR ART

In mass producing consumer products, it is important to maintain a high degree of product uniformity. The expense of adding even a small additional amount of tobacco to every cigarette can be tremendous considering that some cigarette companies routinely produce as many as one billion cigarettes per day. It is also important to maintain physical characteristics of the cigarettes as uniform as possible to insure consumer acceptance of the product. Each cigarette in each pack of a particular brand must be as nearly identical as possible to every other cigarette to meet consumer expectations and insure repeat sales. Variations in the amount of tobacco in a cigarette can affect the firmness of the cigarette rod, the draw characteristics of the cigarette and the taste of the cigarette, all of which can be readily perceived by the smoker.

To manufacture uniform cigarettes, tobacco is built up into a continuous stream and the excess tobacco is trimmed off. In older cigarette making machines, tobacco particles were showered onto a narrow conveyor band to form the continuous tobacco stream. Steps were taken to insure that the showering process, which represents the last step before formation of the actual tobacco rod were as uniform as possible. The excess tobacco was removed from the top of the tobacco stream by means of trimmer devices such as shown by Rault, U.S. Pat. No. 2,660,178 and U.S. Pat. No. 2,660,177. These trimming devices consisted of rotating cutters with overlapping edges, located above the moving stream of tobacco, which removed the upper portion of excess tobacco by means of the rotating cutters and, a spiked wheel in U.S. Pat. No. 2,660,177, and by means of rotating cutters and an air jet in U.S. Pat. No. 2.660,178.

A problem with these older machines in general, was that tobacco showered onto a conveyor and held down by gravity would inevitably still have areas of greater and lesser density which would result in nonuniform products. Also, using a spiked wheel or air jet to remove the excess tobacco above the rotatable cutters often resulted in further damage to the tobacco filler.

More recent cigarette making machines introduce tobacco particles into an air stream which delivers them to an air pervious conveying surface. The air is sucked through the air pervious surface and the particles are left adhering to the bottom of the belt. Tobacco is trimmed to remove tobacco in excess of that required to make the continuous rod. Trimming devices used with this type of cigarette making machine consist generally of two rotating discs, separated by a small gap, cooperating with a rotating brush. An apparatus of this type may be seen in Lanore, U.S. Pat. No. 3,030,966.

A problem associated with this type of trimming device is that the rotating brush damages the tobacco shreds in the process of brushing them from the space between the discs. Also the longer tobacco shreds have a tendency to be pulled out which will affect characteristics in the cigarette, such as coal strength, by reducing the number of long tobacco shreds in the cigarette.

It is, therefore, an object of the present invention to provide an apparatus for trimming the excess tobacco suspended from an air pervious vacuum conveying belt while minimizing damage to the tobacco filler.

A further object of the invention is to provide an apparatus for trimming excess tobacco suspended from an air pervious vacuum conveying belt such that the longer tobacco shreds are not pulled from the tobacco stream.

An additional object of the present invention is to provide an apparatus for trimming the excess tobacco suspended from an air pervious vacuum conveying belt so as to achieve a cigarette with a more uniform physical characteristic as measured from cigarette to cigarette.

SUMMARY OF THE INVENTION

According to the present invention the foregoing and other objects are attained by providing an air pervious vacuum conveying belt onto which tobacco is carried by a moving air stream and from which excess tobacco is removed by two overlapping disc knives.

BRIEF DESCRIPTION OF THE DRAWINGS

A more complete appreciation of the drawings and many of the attendent advantages thereof will be readily apparent by reference to the following detailed description when considered in connection with the accompanying drawings wherein.

DESCRIPTION OF THE PREFERRED EMBODIMENTS

Figure 1:
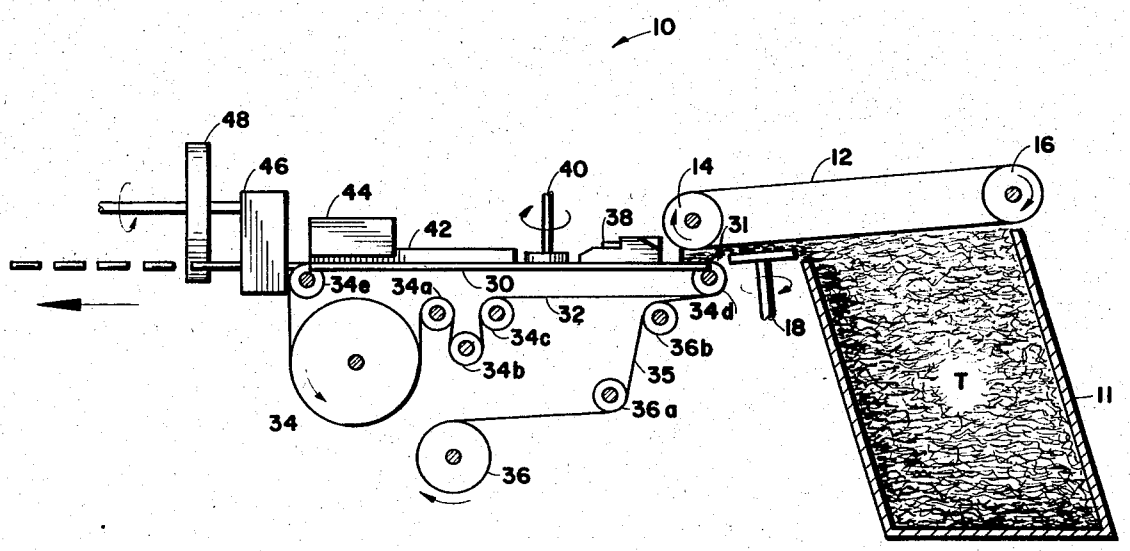
FIG. 1 is a schematic illustration of a cigarette making machine according to the present invention.

Referring now to the drawings and more particularly to FIG. 1, there is illustrated a cigarette making apparatus known as the Mark 9 cigarette maker and commercially available from the Molins Company, designated generally by reference numeral 10. Cigarette maker 10 is shown schematically to include tobacco chimney 11 from which tobacco T is blown onto a perforated vacuum belt 12. Vacuum belt 12 is driven by rollers 14 and 16, and conveys tobacco T to tobacco trimmer device 18. Trimmer device 18 is supported for movement toward or away from the conveyed tobacco in order to vary the amount of tobacco on belt 12 in accordance with cigarette weight or density.

To the left of roller 14, cigarette maker 10 includes an elongated garniture 30 defining an open channel, not shown, extending longitudinally in a generally semicylindrical configuration. A garniture conveyor belt 32 is fed to the upstream tobacco input mouth 31 of the garniture and transported through garniture 30 by drivewheel 34 over idler rollers **34*a*–34*e*. Cigarette paper 35 is fed to mouth 31 on top of garniture belt 32 from supply bobbin 36 over idler rollers 36*a*, 36*b*** and 34*d*. Tobacco falls from belt 12 onto paper 35 as vacuum is removed from the belt.

Short tongue 38 has a compression foot, not shown, which cooperates with garniture 30 to impart a generally cylindrical form to the tobacco, cigarette paper 35, and garniture belt 32 passing beneath the short tongue 38. As the formed tobacco rod leaves short tongue 38 a length of cigarette paper extends from the paper wrapped rod. Paster wheel 40 applies an adhesive to the extending cigarette paper. Folder 42 folds the pasted paper over the rod, completely enclosing the tobacco rod in cigarette paper. Heat seal unit 44 activates the adhesive, sealing the tobacco rod and cigarette paper. The continuous rod now passes through nuclear density gage 46, which measures the density of the rod, and then is cut by rod cut-off mechanism 48 to the proper size.

Figure 2:
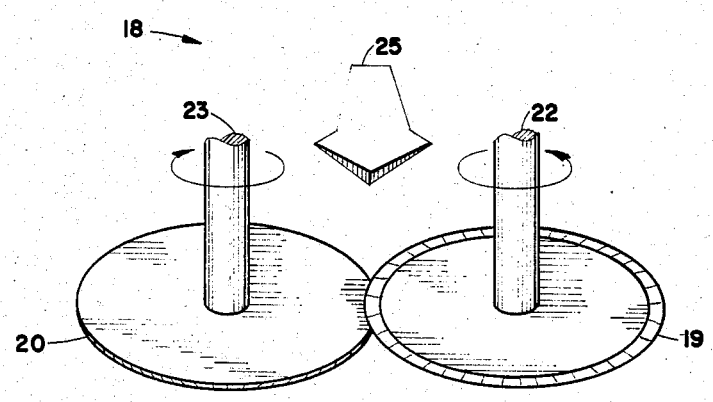
FIG. 2 is a perspective view of the trimmer device of the cigarette making machines shown in FIG. 1.

Referring now to FIG. 2, there is shown a perspective drawing of trimmer knife device 18. Trimmer knife device 18 consists of first disc knife 19 and second disc knife 20. Disc knives 19 and 20 are supported on shafts 22 and 23, respectively, and rotate in opposite directions as indicated so that the directions of motion of the portion of the knife in contact with the tobacco is in the same direction as the movement of the belt 12. Disc knife 20 overlaps disc knife 19 by approximately 5 millimeters (mm) and is separated from the lower surface of knife 19 by approximately 0.05 mm. An overlap of between 2 and 12 mm and separation of 0.025 to 0.075 mm have also been found to be acceptable. The diameter of the disc knives 19 and 20 are approximately 95 mm. The rotational speed of the knives are adjusted so that the linear velocity of the portion of the knives in contact with the tobacco is about 2–10% greater than the velocity of vacuum belt 12. Disc knives about 0.002 to 0.003 mm thick with beveled edges were found to perform best. Disc knife 19 which is closest to the tobacco stream is beveled on its upper surface and disc knife 20 is beveled on its lower surface. Tobacco moves toward the disc knives as indicated by arrow 25.

In actual tests on a cigarette making machine such as described above, the standard deviation using disc knives in accordance with this invention for cigarettes was found to be 17.8 mg for a cigarette with a target weight of 867.3 mg. Control cigarettes made with prior art trimming knives, were found to have a standard deviation of 21.7 mg. Thus, the improvement in standard deviation using the present invention was approximately 3.9 mg.

Figure 3:
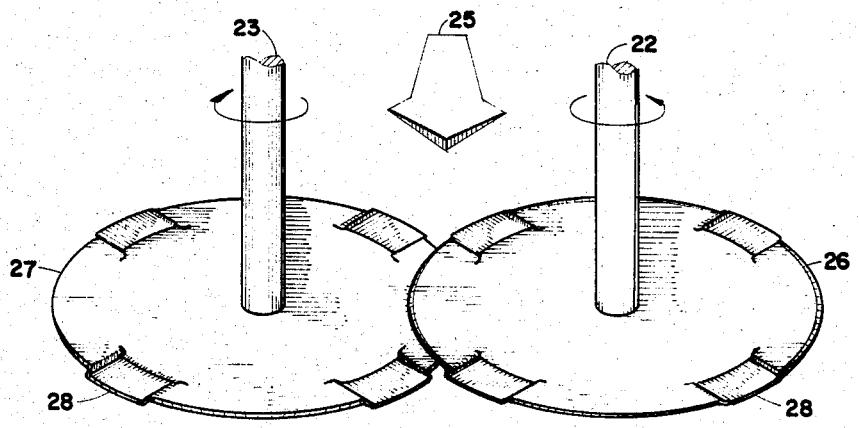
FIG. 3 is a perspective view of another embodiment of the trimmer device of the cigarette making machine shown in FIG. 1.

Referring now to FIG. 3, there is shown an alternate embodiment of a trimmer according to the present invention wherein a first disc knife 26 and second disc knife 27 have pockets 28 spaced around the periphery. The pockets in first disc knife 26 are slightly smaller than those of second disc knife 27 so that when the pockets overlap as they meet beneath vacuum belt 12, the pocket of first disc knife 26 fits into the slightly larger pocket of second disc knife 27. These pockets are provided in disc knives 26 and 27 so that the portion of the tobacco rod cut off by rod cut off mechanism 48 is denser than the remaining portion of the rod. This has been found to be desirable to present a more uniform appearance of the tobacco rod at the cutoff point and to reduce loose ends.

Figure 4:
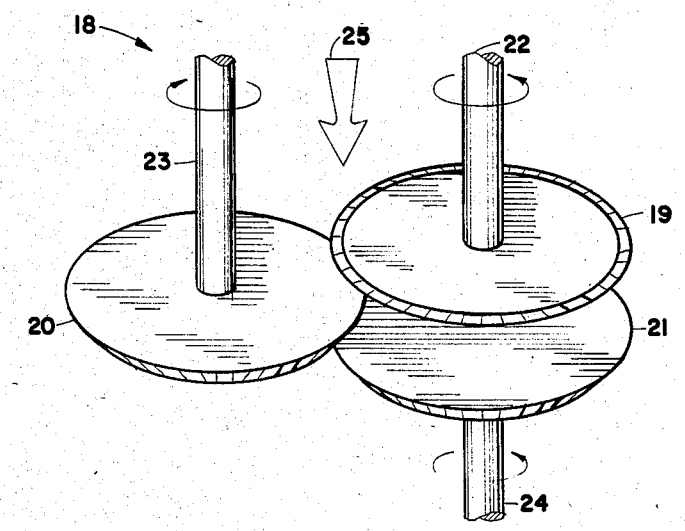
FIG. 4 is a perspective view of an alternative embodiment of the trimmer device of the cigarette making machine shown in FIG. 1.

Referring now to FIG. 4, there is is shown yet another tobacco trimming device 18 according to the present invention wherein an additional third disc knife 21 is incorporated. Third disc knife 21 rotates on shaft 24 in a the same direction as first disc knife 19. Third disc knife 21 is located below second disc knife 20 and separated from second disc knife lower surface by approximately 0.05 mm.

Figure 5:
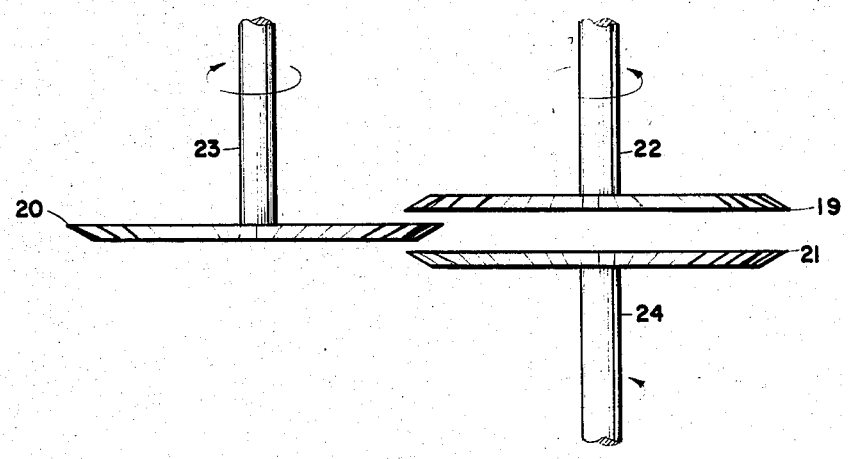
FIG. 5 is a front elevational view of the trimmer device shown in FIG. 4.
Figure 6:
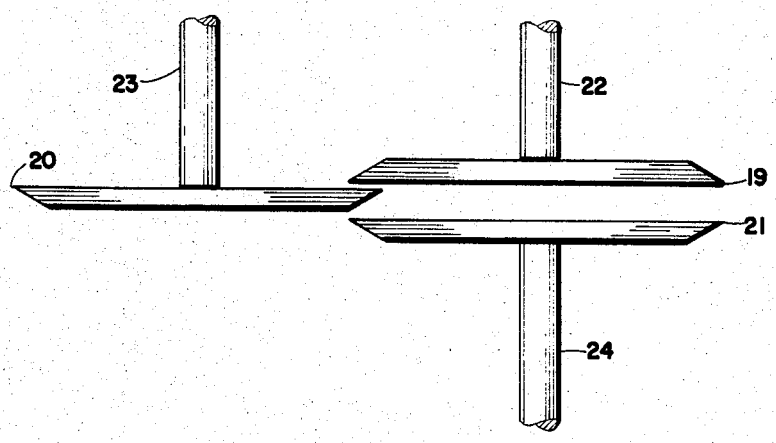

Referring now to FIG. 5, there is shown a elevation of the trimmer knife device 18 shown in FIG. 4 looking from the front. This figure shows in more detail the overlap between disc knives 19, 20 and 21.

We claim:

1. In a continuous rod cigarette making machine having a vacuum belt used to transport tobacco from a hopper suspended on the underside of the vacuum belt, a tobacco trimmer device for removing excess tobacco suspended on the underside of the vacuum belt comprising:

a first disc knife located in a plane parallel to said vacuum belt such that the tobacco passes across said knife only on the outer portion of the knife, said knife rotating in a direction such that the linear direction of movement of the part of said first knife in contact with the tobacco is in the same direction as movement of said vacuum belt;

a second disc knife parallel to the plane of said vacuum belt and said first disc knife, further from said vacuum belt than said first knife and partially overlapping said first knife, rotating in a direction opposite said first knife such that the linear direction of movement of the part of said second knife in contact with the tobacco is in the same direction as movement of said vacuum belt, said first and second knives being rotated at such a speed that the linear velocity of the portion of the knives in contact with the tobacco is approximately two to ten percent faster than the linear velocity of the vacuum belt.

2. In a continuous rod cigarette making machine having a vacuum belt used to transport tobacco from a hopper suspended on the underside of the vacuum belt, a tobacco trimmer device for removing excess tobacco suspended on the underside of the vacuum belt comprising:

a first disc knife located in a plane parallel to said vacuum belt such that the tobacco passes across said knife only on the outer portion of the knife said knife rotating in a direction such that the linear direction of movement of the part of said first knife in contact with the tobacco is in the same direction as movement of said vacuum belt;

a second disc knife parallel to the plane of said vacuum belt and said first disc knife, further from said vacuum belt than said first knife and partially overlapping said first knife, rotating in a direction opposite said first knife such that the linear direction of movement of the part of said second knife in contact with the tobacco is in the same direction as movement of said vacuum belt, said first knife being beveled such that the diameter of the knife face closest to said vacuum belt is less than the diameter of the knife face furthest from said belt, said second knife being beveled such that the diameter of the knife face closest to said vacuum belt is more than the diameter of the knife face furthest from said belt.

3. In a continuous rod cigarette making machine having a vacuum belt used to transport tobacco from a hopper suspended on the underside of the vacuum belt, a tobacco trimmer device for removing excess tobacco suspended on the underside of the vacuum belt comprising:

a first disc knife located in a plane parallel to said vacuum belt such that the tobacco passes across said knife only on the outer portion of the knife said knife rotating in a direction such that the linear direction of movement of the part of said first knife in contact with the tobacco is in the same direction as movement of said vacuum belt;

a second disc knife parallel to the plane of said vacuum belt and said first disc knife, further from said vacuum belt than said first knife and partially overlapping said first knife, rotating in a direction opposite said first knife such that the linear direction of movement of the part of said second knife in contact with the tobacco is in the same direction as movement of said vacuum belt, said first knife and said second knife having pockets placed around the periphery thereof, the rotation of said knives being coordinated so that the pockets overlap as they pass beneath the vacuum belt.

4. A trimmer device as in claim 3 wherein the pockets on said first disc knife are smaller than the pockets on said second disc knife.

* * * * *